US007380657B2

(12) United States Patent
Yeh et al.

(10) Patent No.: US 7,380,657 B2
(45) Date of Patent: Jun. 3, 2008

(54) PROTECTIVE BRACE

(75) Inventors: Guo-Liang Yeh, Shenzhen (CN); Tzu-Cheng Yu, Shenzhen (CN); James Juehui Hong, Shenzhen (CN); Kuan-Hong Hsieh, Shenzhen (CN); Xiao-Guang Li, Shenzhen (CN); Ding-Ding Zhang, Shenzhen (CN)

(73) Assignees: Hong Fu Jin Precision Industry (Shen Zhen) Co., Ltd., Bao'an District, Shenzhen, Guangdong Province, P.R.C.; Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/567,721

(22) Filed: Dec. 6, 2006

(65) Prior Publication Data

US 2008/0041744 A1 Feb. 21, 2008

(30) Foreign Application Priority Data

Aug. 18, 2006 (CN) ..... 2006 1 0062211

(51) Int. Cl.
*B65D 85/30* (2006.01)

(52) U.S. Cl. ..... 206/320; 206/592

(58) Field of Classification Search ..... 206/305, 206/320, 521, 37, 591, 592; 248/309.1, 176.1, 248/345.1; 361/681
See application file for complete search history.

(56) References Cited

U.S. PATENT DOCUMENTS

| | | | | |
|---|---|---|---|---|
| 5,360,108 | A * | 11/1994 | Alagia | 206/320 |
| 5,499,713 | A * | 3/1996 | Huffer | 206/320 |
| 5,648,757 | A * | 7/1997 | Vernace et al. | 206/320 |
| 6,616,111 | B1 * | 9/2003 | White | 248/309.1 |
| 6,646,864 | B2 | 11/2003 | Richardson | |
| 6,896,134 | B2 * | 5/2005 | Russell et al. | 206/320 |
| 6,995,976 | B2 * | 2/2006 | Richardson | 361/681 |

* cited by examiner

*Primary Examiner*—Luan K Bui
(74) *Attorney, Agent, or Firm*—Winston Hsu

(57) ABSTRACT

The invention provided a protective brace for a portable device. The protective brace includes a hold part, a first shock-absorbing part and a second shock-absorbing part. The shock-absorbing parts are at opposite sides of the hold part separately; and each of the anti-vibrate part is wider and higher than the hold part in width and height respectively; the hold part, the first shock-absorbing part, and the second shock-absorbing part define a holder for the portable device. The cute frame-like protective brace have the merits of shock absorbing, open-operation and lightweight.

16 Claims, 6 Drawing Sheets

PROTECTIVE BRACE

BACKGROUND

1. Technical Field

The present invention relates to a protective brace, particularly to a protective brace for a portable device.

2. Related Art

As a tend of portable devices is to become as small and tiny as possible, protecting small, tiny, multi-functional, sophisticated portable devices is a subject itself to electronic designers. Present protective mediums tend to pack the portable devices in a casing, making increasing a volume of the portable device an inconvenient operation.

The U.S. Pat. No. 6,646,864, entitled "Protective case for touch screen device", issued on Nov. 11, 2003, discloses such a protective case of a portable device. The case includes a rigid case and an aperture in the case. A flexible membrane mounts in the aperture for touching the screen of the portable device.

However the present protective case has two disadvantages, firstly, the protective case lacks an shock-absorbing fitting in case the portable device is dropped. Secondly, a user of the portable device cannot operate the portable device directly. In addition, the heavy and bulky protective case impacts the cuteness and lightness of the portable device.

Accordingly, it would be advantageous if the protective case is of shock-absorbing and direct-operating. Another object is to provide a light and cute protective case for the portable device.

SUMMARY

In view of the foregoing disadvantages inherent in the known protective case now present in the prior art, the present invention provides a protective brace make up the shortcomings of present case.

To attain this, the present invention generally includes a hold part, a first shock-absorbing part and a second shock-absorbing part. The shock-absorbing parts are at opposite sides of the hold part separately; and each of the anti-vibrate part is wider and higher than the hold part in width and height respectively; the hold part, the first shock-absorbing part, and the second shock-absorbing part define a holder for the portable device.

A primary object of the present invention is to provide a protective brace which can reduce the damage come from a sudden and violate shock to the portable device.

Another object of the present invention is to provide a protective brace which will not interfere the operation to the portable device.

A further object of the present invention is to provide a light and cute protective brace to carry without increasing the volume and weight of the portable device.

DETAILED DESCRIPTION OF THE EMBODIMENTS

Figure 1:
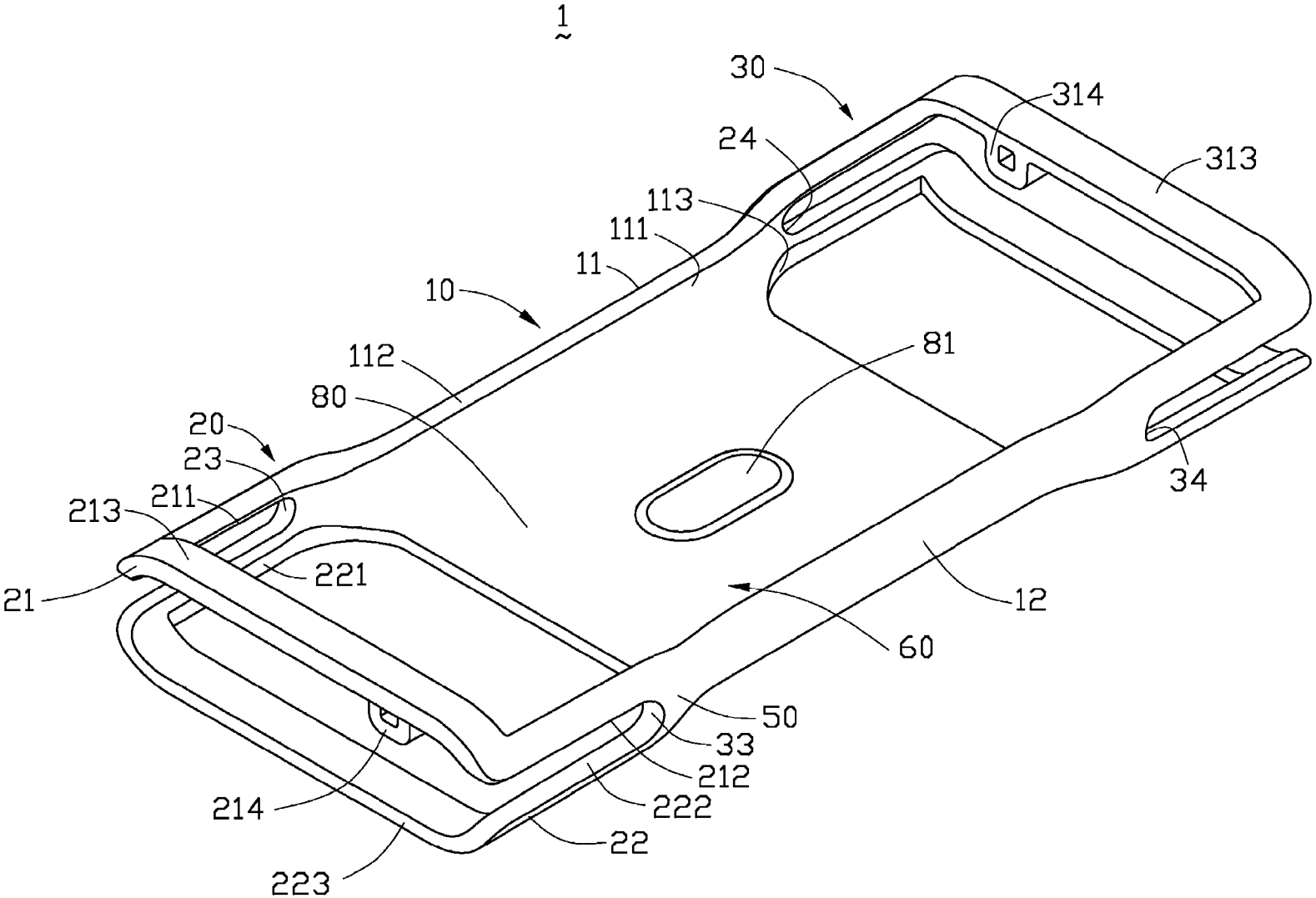
FIG. 1 is a solid view of a protective brace in accordance with a preferred embodiment of the present invention.

FIGS. 1 through 5 illustrate a protective brace in accordance with a preferred embodiment of the present invention. The protective brace 1 includes a hold part 10, a first shock-absorbing part 20, and a second shock-absorbing part 30. The first shock-absorbing part 20 and the second shock-absorbing part 30 are at opposite sides of the hold part 10. The foregoing three parts 10, 20, and 30 defines a holder 60 to hold a portable device 2 (as shown in FIG. 6).

Figure 4:
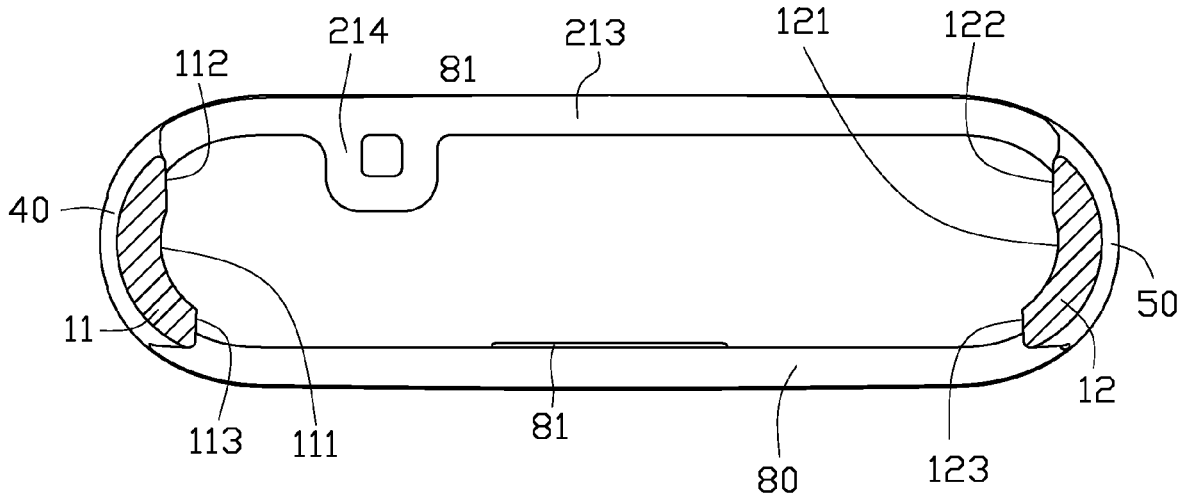
FIG. 4 is a cross sectional view take along line of IV-IV on FIG. 2.

The hold part 10 includes a left wall 11, a right wall 12, and a baseboard 80. The left wall 11 and the right wall 12 extend from opposite sides of the baseboard 80. The left wall 11 includes a concave slot 111, an upper-side 112, and an under-side 113. A cross section of the concave slot 111 is in a half arc form (as shown in FIG. 4) in order to clip the portable device 2. Ends of the concave slot 111 extend outwardly with a pair of opposite concave half-circle borders 23 and 24. Ends of the upper-side 112 extend outwardly and upwardly, while ends of the under-side 113 extend outwardly and downwardly. The structure of the right wall 12 and the structure of the left wall 11 are similar except that the direction thereof is opposite. Therefore, the right wall 12 also has a concave slot 121, an upper-side 122, and an under-side 123. The ends of the concave slot 121 extend outwardly with a pair of opposite concave half-circle borders 33 and 34. The upper-side 122 connects an upper side of the concave slot 121 and the under-side 123 connects an under side of the concave slot 121.

As shown in FIG. 1, a left side of the baseboard 80 connects to the under-side 113 smoothly and a right side of the baseboard 80 connects to the under side 123 smoothly. A soft pad 81, made of a soft material such as a rubber, is embedded in the baseboard 80. Furthermore, a surface of the pad 81 is higher than a top surface of the baseboard 80.

Figure 3:
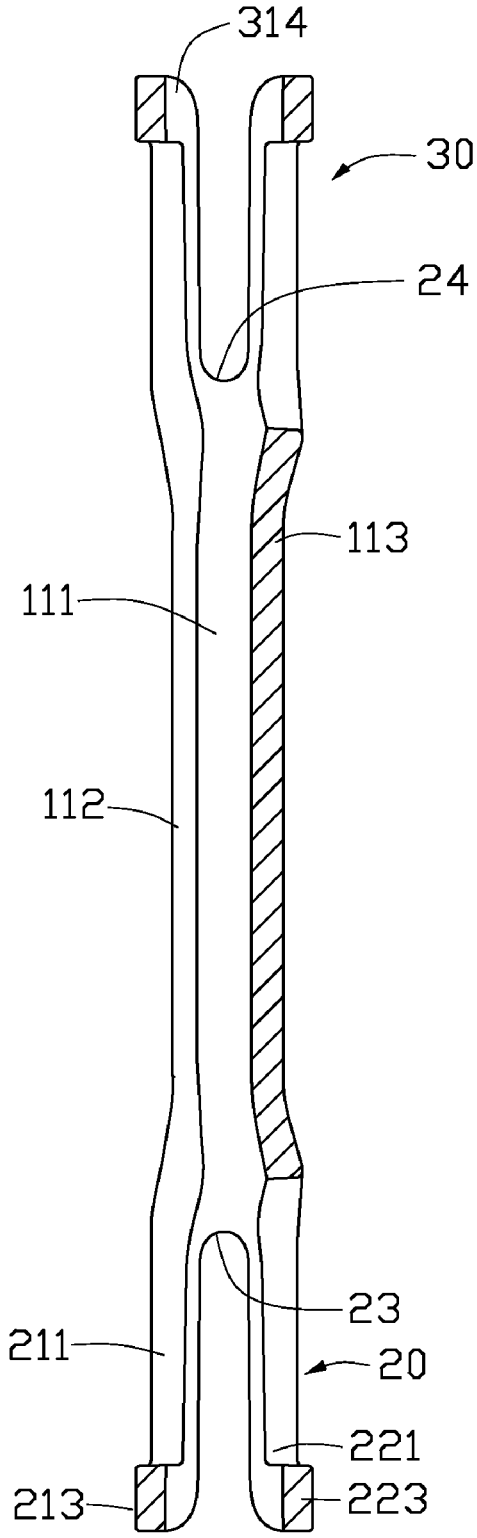
FIG. 3 is a cross sectional view take along line of III-III on FIG. 2.

The first shock-absorbing part 20 includes an upper-frame 21 and an under-frame 22. The upper-frame 21 and the under-frame 22 have a similar shape. The upper-frame 21 includes three parts: a left-side 211, a right-side 212, and a front-side 213 that is vertical to the left-side 211 and the right-side 212. One end of the left-side 211 is smoothly connected to the upper-side 112 of the left wall 11 (as shown in FIG. 3). One end of the right-side 212 is smoothly connected to the upper-side 122 of the right wall 12. A distance between the two sides 211 and 212 of the upper-frame 21 is wider than a distance between the left wall 11 and the right wall 12 of the hold part 10. Ends of the front-side 213 are respectively connected to the left-side 211 and the right-side 212 smoothly.

Similarly, the under-frame 22 includes three parts as: a left-side 221, a right-side 222, and a front-side 223. An end of the left-side 221 is smoothly connected to the lower end of the under side 113 of the left wall 11 (as shown in FIG. 3). An end of the right-side 222 is smoothly connected to the lower end of the under side 123 of the right wall 12. The protective brace 1 further includes two fasteners for alternatively tying a carry cord. The one fastener 214 is fixed on the front-side 213 of the upper-frame 21 of the first shock-absorbing part 20, and the other one fastener 314 is fixed on the front-side 313 of the upper-frame 31 of the second shock-absorbing part 30.

The hold part 10 and the first shock-absorbing part 20 are smoothly connected together and form two joints 40 and 50

Figure 2:
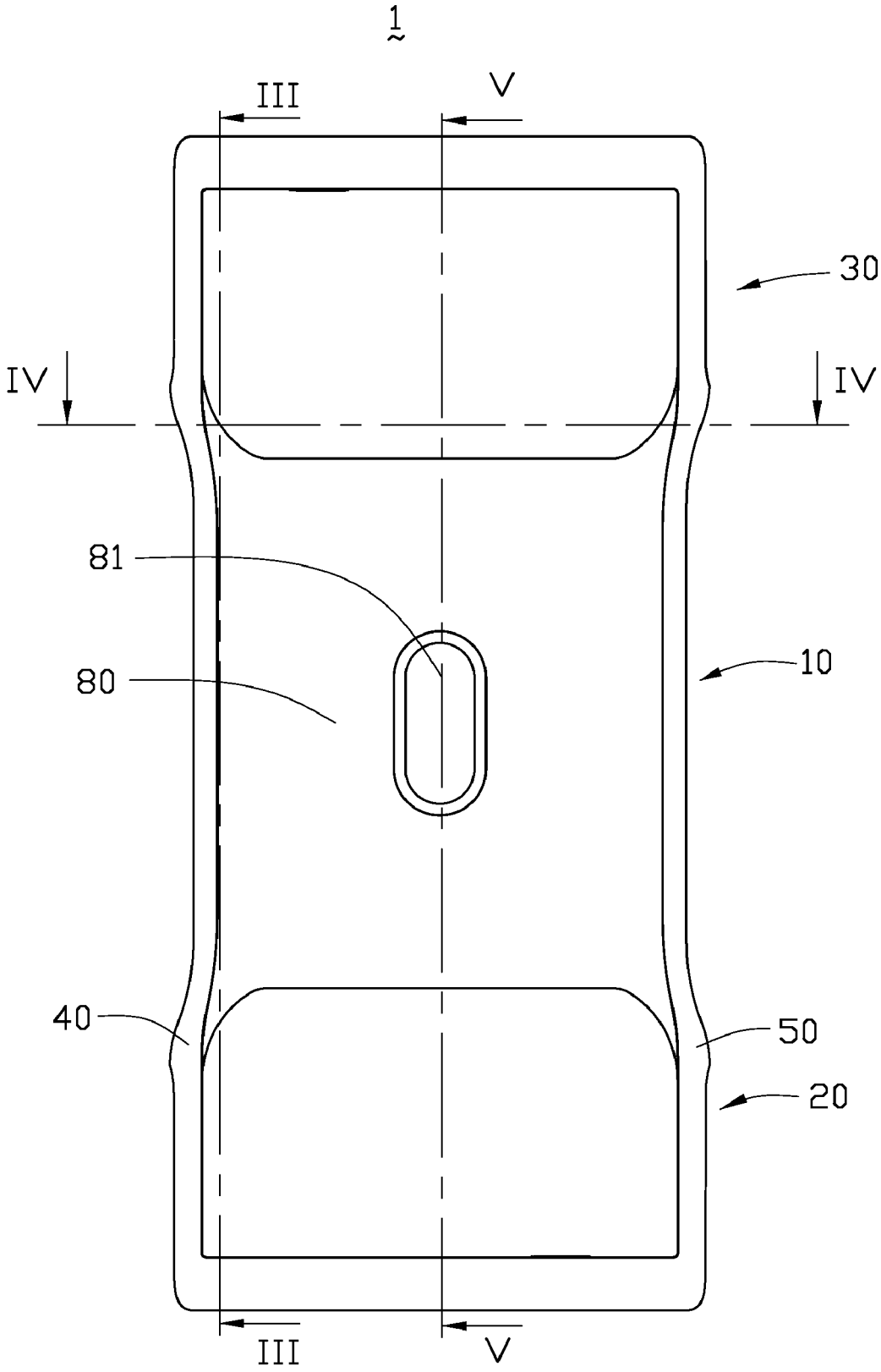
FIG. 2 is a top view of the protective brace of FIG. 1.

(as shown in FIG. 2). The joint 40 is formed by a smooth conjunction of an extended end of the left wall 11 with the left-side 211 of the upper-frame 21 and the left-side 221 of the under-frame 22. The joint 50 is formed by a smooth conjunction of an extended end of the right wall 12 with the right-side 221 of the upper-frame 21 and the right-side 222 of the under-frame 22. From the top view, the width of the first shock-absorbing part 20, as well as the second shock-absorbing part 30, is wider than the hold part 10. The left-side 211 of the upper-frame 21 and the left-side 221 of the under-frame 22 connect to the joint 40 and form a "U" shape. The right-side 212 of the upper-frame 21 and the right-side 222 of the under-frame 22 connect to the joint 50 and form another "U" shape. Similarly structure hereto is the hold part 10 and the second shock absorbing part 30.

Figure 5:
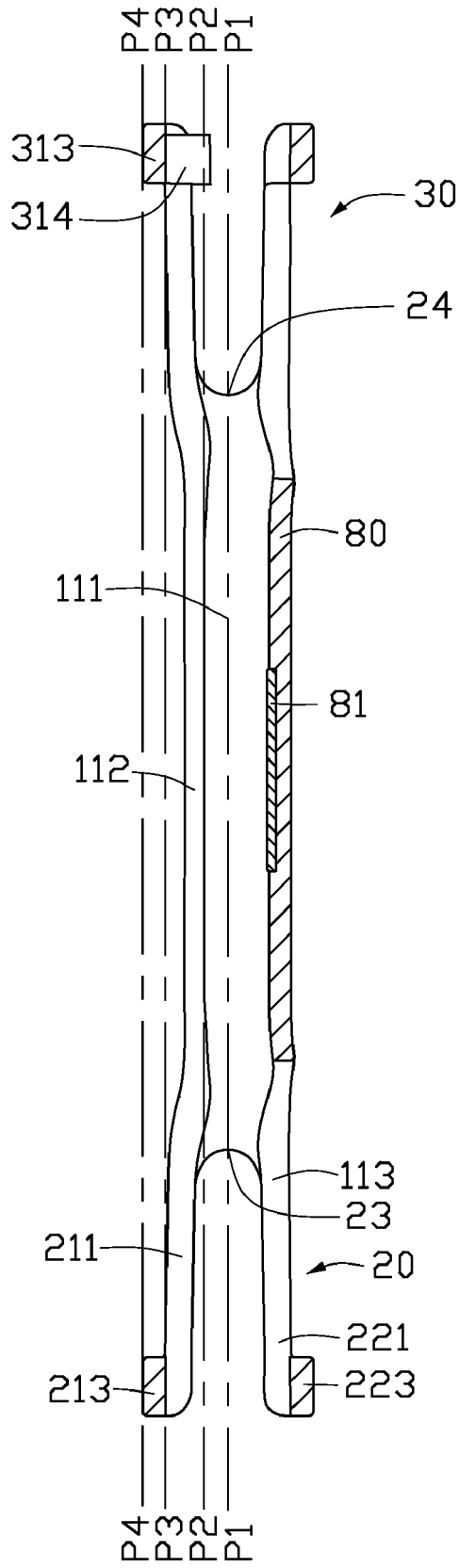
FIG. 5 is a vertical sectional view take along line of V-V on FIG. 2 with four divided planes.
Figure 6:
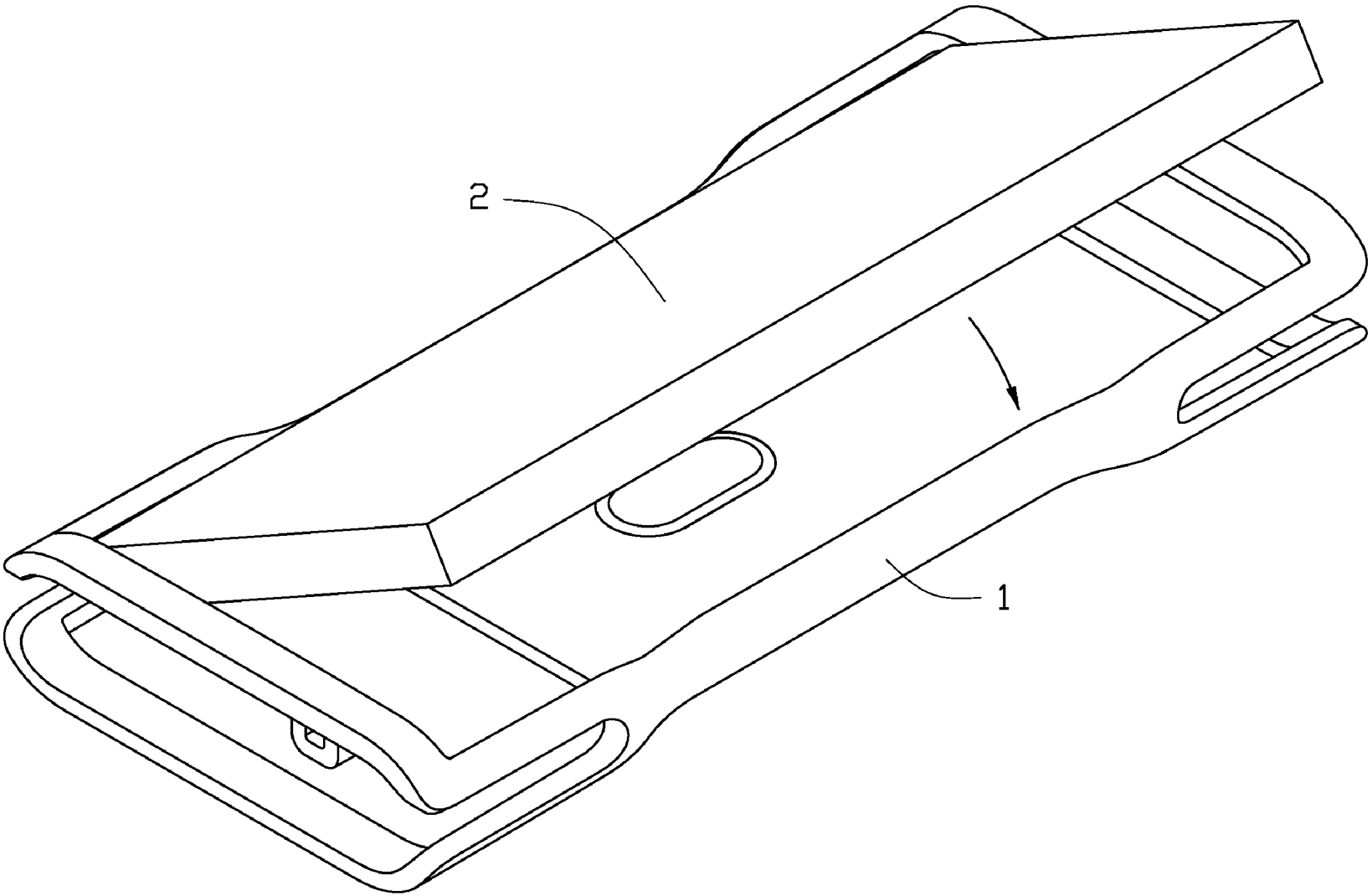
FIG. 6 is a solid view of the protective brace of FIG. 1 when a portable device is set into.

As shown in FIG. 5, from the profile view, a plane P1 is defined by a center axis of the left wall 11 and a center axis of the right wall 12, a part of the protective brace 1 above the plane P1 generally can be divided into three planes, namely: a plane P2 which is defined by the upper sides of the left wall 11 and the upper side of the right wall 12, a plane P3 which is defined by the upper sides of left-side 211 and the upper sides of right-side 212, and a plane P4 which is defined by the front-side 213 of the upper-frame 22 and the front-side of the second shock-absorbing 313. A distance between P3 and P1 is greater than a distance between P2 and P1. A distance between P4 and P1 is higher than a distance between P3 and P1. A part of the protective brace 1 below the plane P2 is similarly divided into three planes and with similar structure. Therefore, the first shock-absorbing part 20 and the second shock-absorbing part 30 are higher than the hold part 10 correspondingly. From the front view of the protective brace 1, the front-side 213 of the upper-frame 21 connects to the left-side 211 and the right-side 212 in two smoothed angles correspondingly. The front-side 223 of the under-frame 22 connects to the left-side 221 and right-side 222 in two smoothed angles correspondingly.

Referring to FIG. 6, a schematic diagram illustrating a process for inserting the portable device 2 into the protective brace 1 is shown. A first step is to put a side of the portable device 2 into the concave slot 111 of the left wall 11 or the concave slot 121 of the right wall 12. A second step is to set the other side of the portable device 2 into the other concave slot 121 or concave slot 111 as the direction as shown as the arrow in FIG. 6. A last step is to tie a cord in the cord fastener 214.

On the one hand, the soft pad 81 servers as a cushion to reduce collision occurred when the portable device 2 is inserted into the protective brace 1. On the other hand, the soft pad 81 also helps the portable device 2 to compact the space of the holder 60. Because the first shock-absorbing part 20 is higher than the hold part 10, there is a space between the portable device 2 and the upper-frame 21 and the under-frame 22 of the first shock-absorbing part 20. And the same situation exists between the portable device 2 and the second shock-absorbing part 30. When the portable device 2 falls, the damage result from the falling can be reduced because these spaces absorb the collision impact. On the other hand, when the protective brace 1 with the portable device 2 is put on a desktop or some panel, there is a space between the surface of the hold part 10 and the panel in order to avoid the portable device being scratched.

The thinner hold part 10 is convenient for a user to operate when the portable device 2 is in use. The user can operate the portable device 2 directly without the obstruction of a cover or a membrane on the surface of the portable device 2. Such a structure is ingenious to wind the earphone line or other line-like fittings when the portable device 2 is unused. In addition, the protective brace 1 with such a frame structure not only saves the produce material, but also reduces the invention's volume and weight.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A protective brace adapted for a portable device, comprising:

a hold part;

a first shock-absorbing part with an upper-frame and an under-frame; and a second shock-absorbing part with an upper-frame and an under-frame;

wherein the first shock-absorbing part and the second shock-absorbing part are at opposite sides of the hold part respectively, the first shock-absorbing parts and the second shock-absorbing parts are wider and higher than the hold part; the hold part and the first shock-absorbing part are smoothly connected together and form two joints; the upper-frame and the under-frame of the first shock-absorbing part are connected to the two joints and form a pair of "U" shapes at both sides of the first shock-absorbing part; the hold part and the second shock-absorbing part are smoothly connected together and form another two joints; the upper-frame and the under-frame of the second shock-absorbing part are connected to the two joints and form a pair of "U" shapes at both sides of the second shock-absorbing part; the hold part, the first shock-absorbing part, and the second shock-absorbing part defining a holder for the portable device.

2. The protective brace according to claim 1, wherein the hold part comprises a left wall, a right wall, and a baseboard, the left wall and the right wall extending from opposite sides of the baseboard.

3. The protective brace according to claim 2, wherein the left wall and the right wall each comprise a concave slot, an upper-side, and an under-side; the under-side of the left wall connects to the left side of the baseboard; the under-side of the right wall connects to the right side of the baseboard.

4. The protective brace according to claim 3, wherein a cross section of the concave slot is in a half arc form.

5. The protective brace according to claim 3, wherein ends of concave slot extend outwardly with a pair of opposite concave half-circle borders; ends of the upper-side extend outwardly and upwardly; and ends of the under-side extend outwardly and downwardly.

6. The protective brace according to claim 5, wherein one of the joint is formed by the smooth conjunction of extended end of the left wall with the left-side of the upper-frame and the left side of the under-frame, and the other joint is formed by the smooth conjunction of extended end of the right wall with the right-side of the upper-frame and the right-side of the under-frame.

7. The protective brace according to claim 3, wherein a pad is set in a top surface of the baseboard.

8. The protective brace according to claim 7, wherein the pad is made of soft material.

9. The protective brace according to claim 3, wherein the first shock-absorbing part and the second shock-absorbing part each comprise an upper-frame and an under-frame.

10. The protective brace according to claim 9, wherein the upper-frame comprises a left-side, a right-side, and a front-side, the front-side being vertical to the left-side and the right-side.

11. The protective brace according to claim 10, wherein one end of the left-side of the upper-frame is smoothly connected to the upper-side of the left wall, and the right-side of the upper-frame is smoothly connected to the upper-side of the right wall.

12. The protective brace according to claim 10, wherein the left-side of the under-frame is smoothly connected to one end of the under-side of the left wall, and the right-side of the under-frame is smoothly connected to one end of the under-side of the right wall.

13. The protective brace according to claim 11, wherein a plane defined by the two front-sides of the upper-frames of the first and the second shock-absorbing is higher than a plane defined by the left-sides and right-side of the upper-frame.

14. The protective brace according to claim 13, wherein the front-side of the upper-frame connects to the left-side and the right-side by two smoothed angles, and the front-side of the under-frame connects to the left-side and right-side by two smoothed angles.

15. The protective brace according to claim 11, wherein the protective brace at least comprises a fastener for tying a carry cord.

16. The protective brace according to claim 15, wherein the fastener is fixed on the front-side of the upper-frame.

* * * * *